US008672778B2

(12) United States Patent
Moriyama

(10) Patent No.: US 8,672,778 B2
(45) Date of Patent: Mar. 18, 2014

(54) GOLF BALL

(75) Inventor: Keiji Moriyama, Kobe (JP)

(73) Assignee: SRI Sports Limited, Kobe (JP)

( * ) Notice: Subject to any disclaimer, the term of this patent is extended or adjusted under 35 U.S.C. 154(b) by 845 days.

(21) Appl. No.: 12/076,083

(22) Filed: Mar. 13, 2008

(65) Prior Publication Data

US 2008/0227570 A1 Sep. 18, 2008

(30) Foreign Application Priority Data

Mar. 15, 2007 (JP) ..... 2007-065948

(51) Int. Cl.
*A63B 37/12* (2006.01)

(52) U.S. Cl.
USPC ..... 473/383

(58) Field of Classification Search
USPC ..... 473/383–385
See application file for complete search history.

(56) References Cited

U.S. PATENT DOCUMENTS 5,735,757 A 4/1998 Moriyama et al.
6,368,238 B1 4/2002 Kasashima et al.
6,780,128 B2 8/2004 Moriyama et al.
6,986,720 B2 1/2006 Sajima et al.
2004/0102259 A1* 5/2004 Ohama et al. ..... 473/378
2005/0101412 A1 5/2005 Sajima et al.
2005/0113188 A1* 5/2005 Sajima ..... 473/383

FOREIGN PATENT DOCUMENTS

JP 2005-137692 A 6/2005
JP 2006-314481 A 11/2006

* cited by examiner

*Primary Examiner* — Raeann Gorden
(74) *Attorney, Agent, or Firm* — Birch, Stewart, Kolasch & Birch, LLP

(57) ABSTRACT

Golf ball 2 has a land and numerous dimples 8 on the surface thereof. This dimple 8 has first curved face 14 and second curved face 16. The first curved face 14 is continuous with land 10 at the edge Ed. The second curved face 16 is continuous with the first curved face 14 at the boundary point Pb. The first curved face 14 has ring-shape. The first curved face 14 is projecting upwards. The second curved face 16 has a bowl-shape. The second curved face 16 is projecting downwards. The second curved face 16 has a curvature radius R2 of equal to or greater than 10 mm. The proportion P1 of the depth d1 of the boundary point Pb to the depth de of the dimple 8 is 1% or greater and 10% or less. The mean diameter of the dimple 8 is equal to or greater than 4.0 mm. The proportion P3 of the number of the dimples 8 having a diameter of equal to or greater than 4.3 mm to total number of the dimples 8 is equal to or greater than 30%.

1 Claim, 15 Drawing Sheets

A
A
A

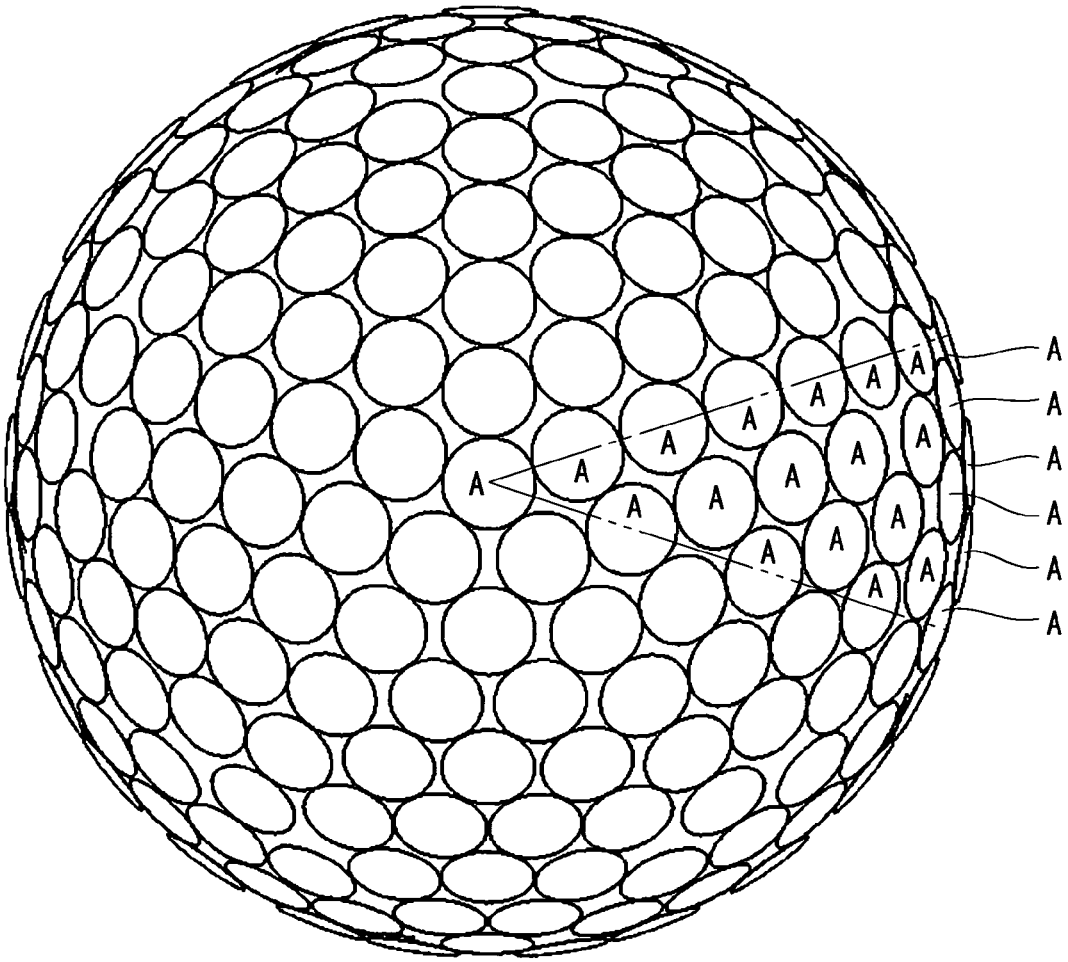
A
A
A

GOLF BALL

This application claims priority on Patent Application No. 2007-65948 filed in JAPAN on Mar. 15, 2007. The entire contents of this Japanese Patent Application are hereby incorporated by reference.

BACKGROUND OF THE INVENTION

1. Field of the Invention

The present invention relates to golf balls. More particularly, the present invention relates to improvement of dimples of golf balls.

2. Description of the Related Art

Golf balls hit by a golf club make a flight with accompanying back spin. The back spin results in lift force that acts on the golf ball. The lift force leads to satisfactory height of a trajectory and flight duration of the golf ball, whereby a great flight distance can be achieved.

Due to excessive backspin, a great drag acts on the golf ball. The drag can reduce the flight distance. In light of suppression of the drag, the spin rate is preferably lower. However, low spin rate may result in insufficient lift force.

Golf balls in recent years achieve both a low spin rate and a great launch angle. A great height of the trajectory and flight duration can be attained by a great launch angle. A great launch angle compensates for insufficiency of the lift force. However, this complementation is not enough.

Japanese Unexamined Patent Application Publication No. 2002-186684 (U.S. Pat. No. 6,780,128) discloses a golf ball having dimples with large size. A great lift force can be attained by the dimples with large size even though the spin rate is low. However, the drag is not sufficiently suppressed according to this golf ball.

Japanese Unexamined Patent Application Publication Nos. Hei 9-70449 (U.S. Pat. No. 5,735,757), 2000-279553 (U.S. Pat. No. 6,368,238) and 2004-321529 (U.S. Pat. No. 6,986,720) disclose golf balls having dimples with a contrived cross-sectional shape. However, these golf balls still exhibit insufficient lift force when the spin rate is low.

Top concern to golf players for golf balls is their flight distance. There exists room for improvement of flight performances of the golf balls. An object of the present invention it to provide a golf ball that is excellent in the flight performance.

SUMMARY OF THE INVENTION

The golf ball according to the present invention has a land and numerous dimples on the surface thereof. The proportion of total area of all the dimples to the surface area of the phantom sphere is equal to or greater than 75%. The mean diameter of these dimples is equal to or greater than 4.0 mm. The proportion of the number of the dimples having a diameter of equal to or greater than 4.3 mm to total number of the dimples is equal to or greater than 30%. These dimples include dimples having a particular shape. The dimples having the particular shape are characterized as in the following (1) to (3):

(1) having a first curved face that has ring-shape, and that is continuous with the land at the edge of the dimple and is projecting upwards;

(2) having a second curved face that has a bowl-shape, and that is continuous with the first curved face, and is projecting downwards and having a curvature radius of equal to or greater than 10 mm; and (3) with the depth of the boundary of the first curved face and the second curved face accounting for 1% or greater and 10% or less of the depth of the dimple.

In this golf ball, the first curved face is present in the vicinity of the edge. The shape in the vicinity of the edge is different from those of conventional golf balls. The first curved face is responsible for suppression of the drag. Furthermore, an adequate lift force is achieved due to the first curved face. This golf ball is excellent in the flight performance.

Preferably, the proportion of the number of the dimples having the particular shape to total number of the dimples is equal to or greater than 50%. Preferably, standard deviation of the dimple diameter is equal to or less than 0.2 mm.

BRIEF DESCRIPTION OF THE DRAWINGS

FIG. 15 shows a plan view illustrating the golf ball shown in FIG. 14.

DESCRIPTION OF THE PREFERRED EMBODIMENTS

Hereinafter, the present invention will be described in detail according to preferred embodiments with appropriate references to the accompanying drawing.

Figure 1:
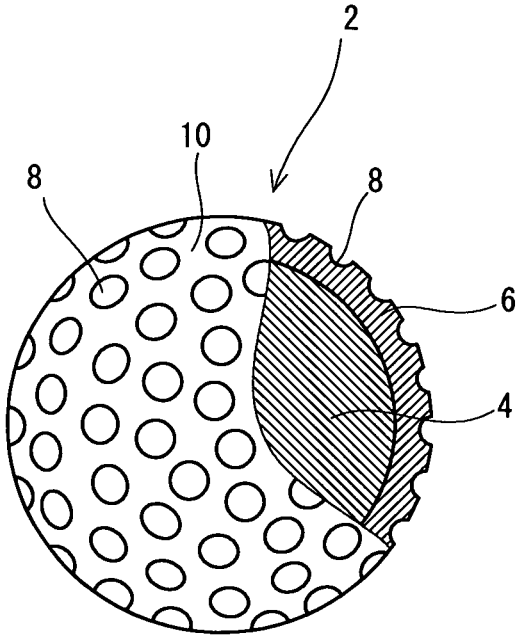
FIG. 1 shows a schematic cross-sectional view illustrating a golf ball according to one embodiment of the present invention.

Golf ball 2 shown in FIG. 1 has spherical core 4 and cover 6. Numerous dimples 8 are formed on the surface of the cover 6. Of the surface of the golf ball 2, a part except for the dimples 8 is land 10. This golf ball 2 has a paint layer and a mark layer to the external side of the cover 6, although these layers are not shown in the Figure.

This golf ball 2 has a diameter of 40 mm or greater and 45 mm or less. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. The weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is more preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is suitably used. Examples of the co-crosslinking agent that is preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a sulfur compound, a filler, an anti-aging agent, a coloring agent, a plasticizer, a dispersant and the like may be blended in an adequate amount into the rubber composition of the core 4 as needed. Into the rubber composition may be also blended crosslinked rubber powder or synthetic resin powder.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers. A mid layer may be provided between the core 4 and the cover 6.

Polymer which may be suitably used in the cover 6 is an ionomer resin. Examples of preferred ionomer resin include binary copolymers formed with α-olefin and an α,β-unsaturated carboxylic acid having 3 or more and 8 or less carbon atoms. Examples of other preferred ionomer resin include ternary copolymers formed with α-olefin, an α,β-unsaturated carboxylic acid having 3 or more and 8 or less carbon atoms, and an α,β-unsaturated carboxylate ester having 2 or more and 22 or less carbon atoms. In such binary copolymer and ternary copolymer, preferable α-olefin is ethylene and propylene, and preferable α,β-unsaturated carboxylic acid is acrylic acid and methacrylic acid. In these binary copolymer and ternary copolymer, a part of the carboxyl group is neutralized with a metal ion. Illustrative examples of the metal ion for use in neutralization include sodium ion, potassium ion, lithium ion, zinc ion, calcium ion, magnesium ion, aluminum ion and neodymium ion.

Other polymer may be used in place of or together with the ionomer resin. Illustrative examples of the other polymer include thermoplastic polyurethane elastomers, thermoplastic styrene elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.3 mm, and particularly equal to or greater than 0.4 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
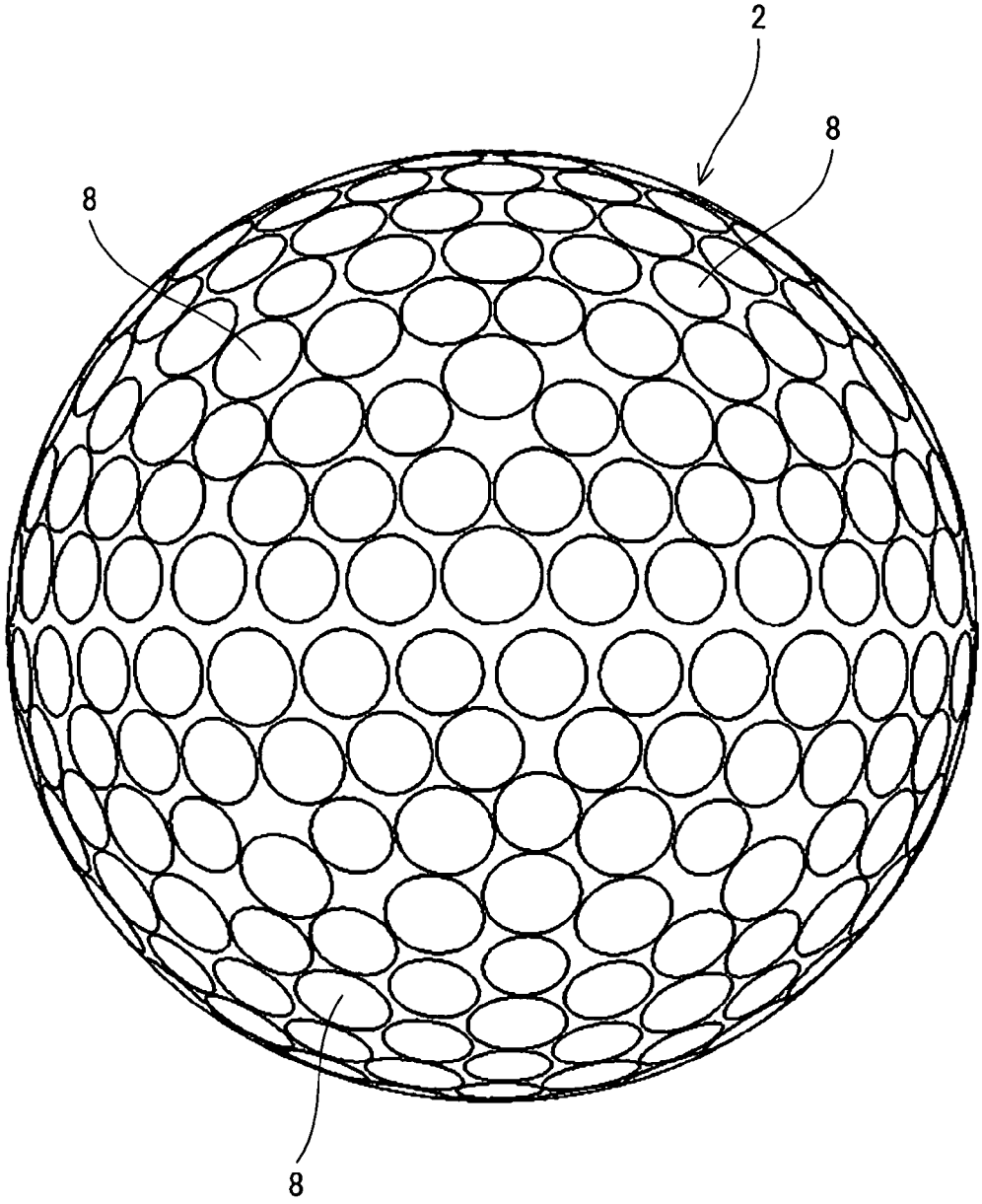
FIG. 2 shows an enlarged front view illustrating the golf ball shown in FIG. 1.
Figure 3:
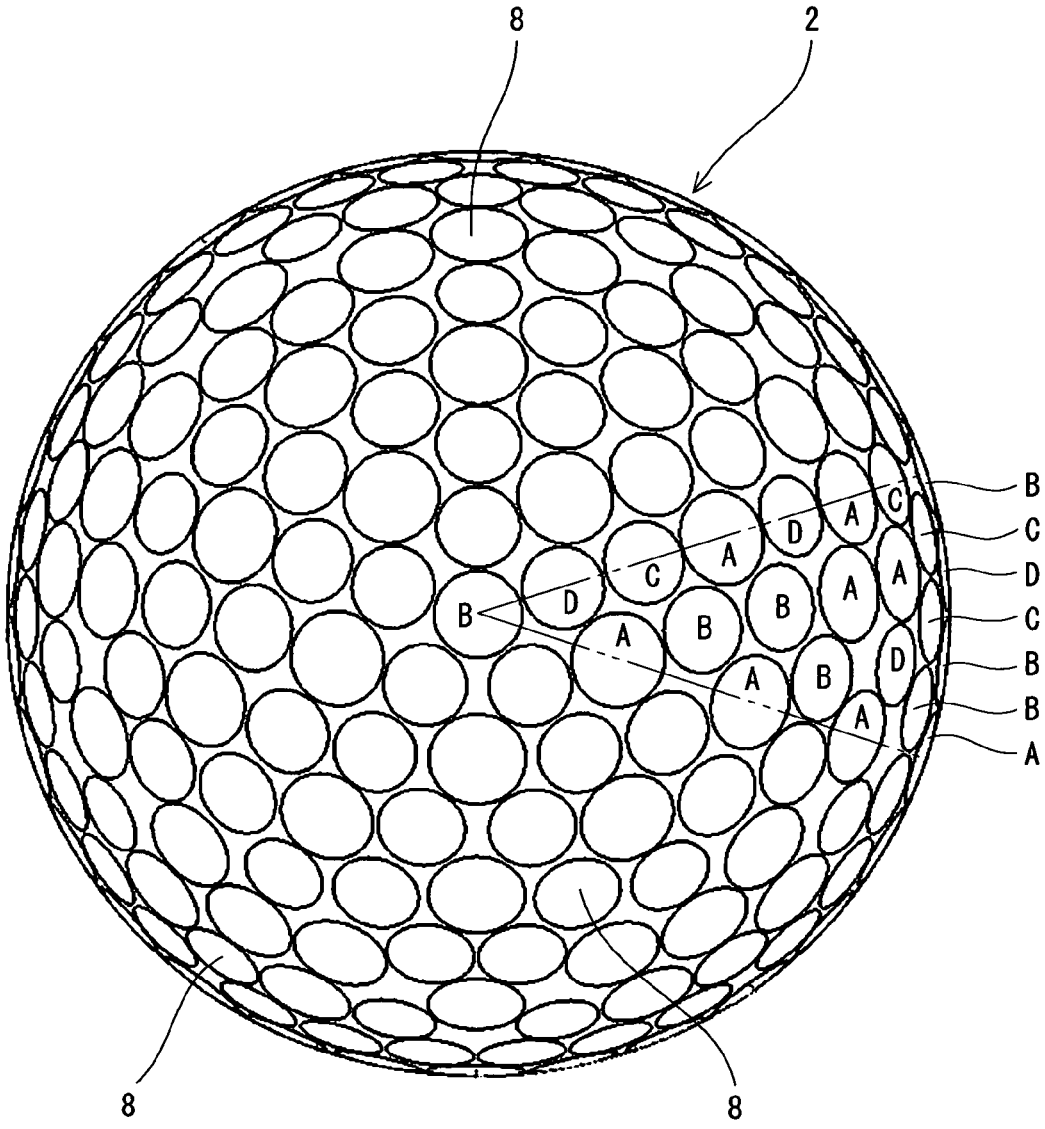
FIG. 3 shows a plan view illustrating the golf ball shown in FIG. 2.

FIG. 2 shows an enlarged front view illustrating the golf ball 2 shown in FIG. 1, and FIG. 3 shows a plan view of the same. As is clear from FIG. 2 and FIG. 3, all dimples 8 have a circular plane shape. In FIG. 3, types of the dimples 8 are indicated by reference signs A to D in one unit provided when the surface of the golf ball 2 is comparted into 20 equivalent units. This golf ball 2 has dimples A having a diameter of 4.40 mm, dimples B having a diameter of 4.00 mm, dimples C having a diameter of 3.85 mm, and dimples D having a diameter of 3.80 mm. The number of the dimples A is 100; the number of the dimples B is 112; the number of the dimples C is 60; and the number of the dimples D is 60. Total number of the dimples 8 is 332.

Figure 4:
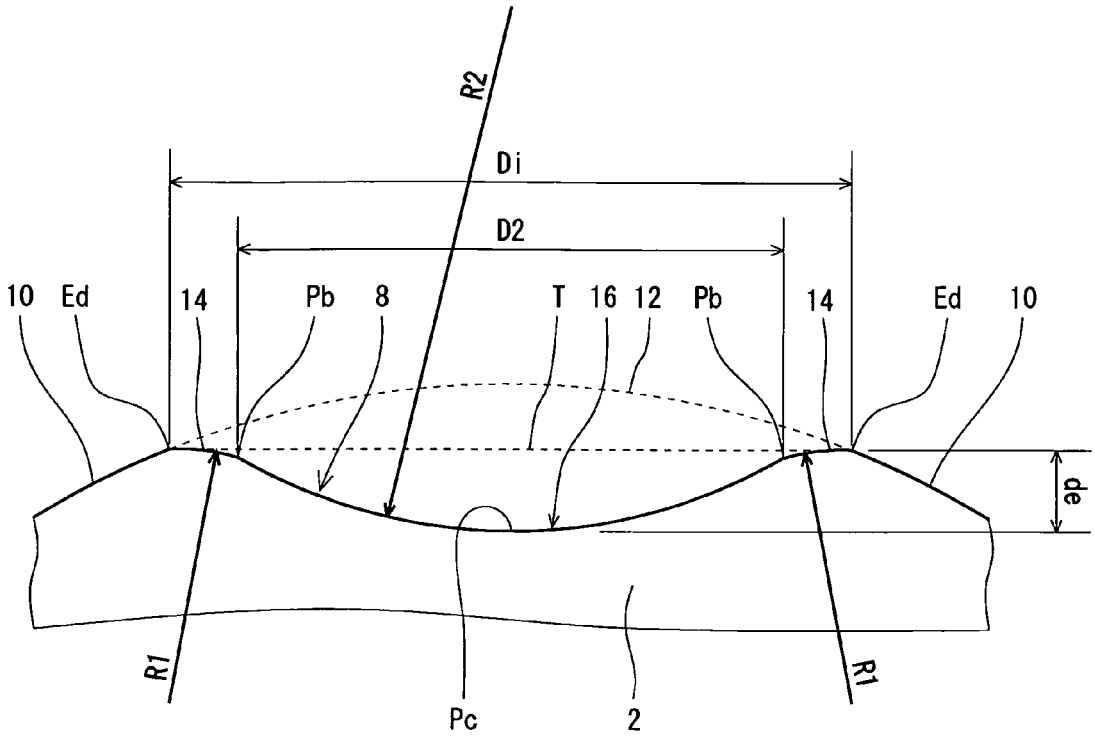
FIG. 4 shows an enlarged cross-sectional view illustrating a part of the golf ball shown in FIG. 1.

FIG. 4 shows an enlarged cross-sectional view illustrating a part of the golf ball 2 shown in FIG. 1. In this FIG. 4, a cross section taken along a plane that passes through the areal center of gravity of the dimple 8, and the center of the golf ball 2 is shown. A top-to-bottom direction in FIG. 4 is an in-depth direction of the dimple 8. What is indicated by a chain double-dashed line 12 in FIG. 4 is a phantom sphere. The surface of phantom sphere 12 corresponds to the surface of the golf ball 2 when it is postulated that there exists no dimple 8. The dimple 8 is recessed from the phantom sphere 12. The land 10 agrees with the phantom sphere 12.

In FIG. 4, what is indicated by a both-oriented arrowhead Di is the diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 3.5 mm or greater and 5.0 mm or less. The dimple 8 having a diameter Di of equal to or greater than 3.5 mm serves in achieving excellent aerodynamic characteristics. In this respect, the diameter Di is more preferably equal to or greater than 3.8 mm. The dimple 8 having a diameter Di of equal to or less than 5.0 mm does not impair a fundamental feature of the golf ball 2 which is substantially a sphere. In this respect, the diameter Di is more preferably equal to or less than 4.7 mm.

In FIG. 4, what is indicated by a both-oriented arrowhead de is the depth of the dimple 8. The depth de is a distance between the tangent line T, and the most inferior point Pc of the dimple 8. In light of possible suppression of hopping of the golf ball 2, the depth de is preferably equal to or greater than 0.10 mm, and more preferably equal to or greater than 0.12 mm. In light of possible suppression of dropping of the golf ball 2, the depth de is preferably equal to or less than 0.20 mm, and more preferably equal to or less than 0.16 mm.

Figure 5:
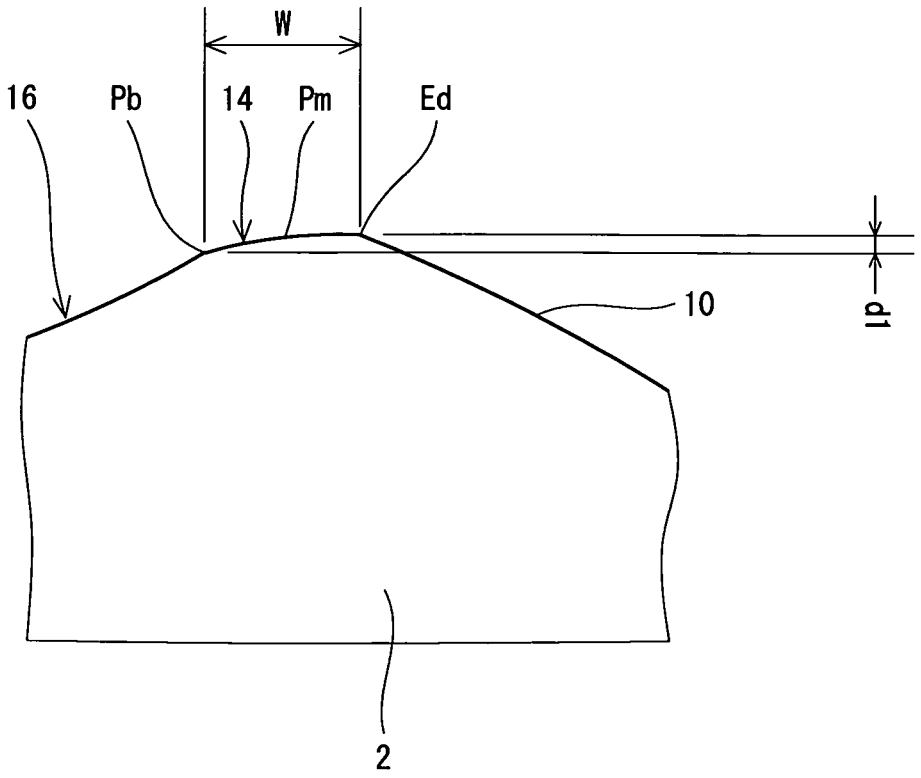
FIG. 5 shows a further enlarged cross-sectional view illustrating a part of the golf ball shown in FIG. 4.

FIG. 5 shows a further enlarged cross-sectional view illustrating a part of the golf ball 2 shown in FIG. 4. The dimple 8 has a first curved face 14 and a second curved face 16. The first curved face 14 is continuous with the land 10 at the edge Ed. The second curved face 16 is continuous with the first curved face 14 at a boundary point Pb.

The first curved face 14 has ring-shape. The first curved face 14 is projecting upwards. Preferably, the first curved face 14 has a cross-sectional shape being a circular arc. In FIG. 4, what is indicated by an arrowhead R1 is the curvature radius of the first curved face 14. The point Pm in FIG. 5 is a midpoint between the edge Ed and the boundary point Pb. When the first curved face 14 does not have a cross-sectional shape being a circular arc, a circle that passes the edge Ed, the midpoint Pm and the boundary point Pb is envisioned, and the radius of this circle is defined as the curvature radius R1.

The second curved face 16 has a bowl-shape. The second curved face 16 is positioned at the center of the dimple 8. The second curved face 16 is projecting downwards. Preferably, the second curved face 16 has a cross-sectional shape being a circular arc. In FIG. 4, what is indicated by an arrowhead R2 is a curvature radius of the second curved face 16. When the second curved face 16 does not have a cross-sectional shape being a circular arc, a circle that pass one of the boundary points Pb, the most inferior point Pc and the other boundary point Pb is envisioned, and the radius of this circle is defined as the curvature radius R2.

Although detailed grounds are unknown, the dimple 8 having the first curved face 14 and the second curved face 16 suppresses the drag, and serves in achieving an adequate lift force. This golf ball 2 is excellent in the flight performance.

In FIG. 5, what is indicated by an arrowhead d1 is the depth of the boundary point Pb from the edge Ed. The proportion P1 of the depth d1 with respect to the depth de of the dimple 8 is 1% or greater and 10% or less. The first curved face 14 having the proportion P1 of equal to or greater than 1% suppresses the drag, and serves in achieving an adequate lift force. In this respect, this proportion P1 is more preferably equal to or greater than 4.0%, and particularly preferably equal to or greater than 4.5%. The first curved face 14 having this proportion P1 of equal to or less than 10% suppresses an excessive lift force. An adequate lift force suppresses hopping of the golf ball 2. In this respect, this proportion P1 is more preferably equal to or less than 8%.

The curvature radius R1 is preferably equal to or greater than 0.2 mm. The first curved face 14 having a curvature radius R1 of equal to or greater than 0.5 mm is responsible for suppression of the drag. In this respect, the curvature radius R1 is more preferably equal to or greater than 0.5 mm. The curvature radius R1 is preferably equal to or less than 2.0 mm. The first curved face 14 having a curvature radius R1 of equal to or less than 2.0 mm suppresses an excessive lift force. In this respect, the curvature radius R1 is more preferably equal to or less than 1.0 mm.

The second curved face 16 has a curvature radius R2 of equal to or greater than 10 mm. This second curved face 16 serves in achieving an adequate lift force. In this respect, the curvature radius R2 is more preferably equal to or greater than 12 mm. In light of suppression of the drag, and suppression of excessive lift force, the curvature radius R2 is preferably equal to or less than 25 mm, and more preferably equal to or less than 18 mm.

In FIG. 4, what is indicated by an arrowhead D2 is the diameter of the second curved face 16. In FIG. 5, what is indicated by an arrowhead W is the width of the first curved face 14. The width W is calculated by the following formula:

$$W=(Di-D2)/2$$

The width W is preferably 0.05 mm or greater and 0.15 mm or less. The first curved face 14 having a width W of equal to or greater than 0.05 mm suppresses the drag, and serves in achieving an adequate lift force. The first curved face 14 having a width W of equal to or less than 0.15 mm suppresses an excessive lift force. The adequate lift force suppresses hopping of the golf ball 2.

In the present invention, the dimple 8 characterized as in the following (1) to (3) is referred to as "dimple having a particular shape":

(1) having a first curved face 14 that has ring-shape, and that is continuous with the land 10 at the edge Ed of the dimple 8 and is projecting upwards;

(2) having a second curved face 16 that has a bowl-shape, and that is continuous with the first curved face 14, and is projecting downwards and having a curvature radius R2 of equal to or greater than 10 mm; and (3) with the depth d1 of the boundary of the first curved face 14 and the second curved face 16 accounting for 1% or greater and 10% or less of the depth de of the dimple 8.

Inspection of FIG. 4 reveals that the first curved face 14 that has a ring shape and that is continuous with the land 10 at the edge Ed of the dimple 8 and is projecting upwards from the second curved face 16 that has a bowl shape and that is continuous with the first curved face 14, and inspection of FIG. 4 reveals that, although the first curved surface 14 intersects the second curved surface 16, there is a corner or bend in curvature where they intersect, i.e., at boundary point Pb.

In light of the flight performance, the proportion P2 of the number of the dimples 8 having the particular shape to total number of the dimples 8 is preferably equal to or greater than 50%, and more preferably equal to or greater than 80%. Ideally, this proportion P2 is 100%.

Area s of the dimple 8 is an area of a region surrounded by the contour line when the center of the golf ball 2 is viewed at infinity. In instances of a circular dimple 8, the area s is calculated by the following formula:

$$s=(Di/2)^2\cdot\pi.$$

In the golf ball 2 shown in FIG. 2 and FIG. 3, the area of the dimple A is 15.21 $mm^2$; the area of the dimple B is 12.57 $mm^2$; the area of the dimple C is 11.64 $mm^2$; and the area of the dimple D is 11.34 $mm^2$.

According to the present invention, the proportion of sum total of area s of all the dimples 8 to the surface area of the phantom sphere 12 is referred to as an occupation ratio. From the standpoint that an adequate lift force may be attained, the occupation ratio is preferably equal to or greater than 75%, and more preferably equal to or greater than 79%. From the standpoint that interference among the dimples 8 can be suppressed, the occupation ratio is preferably equal to or less than 90%. According to the golf ball 2 shown in FIG. 2 and FIG. 3, total area of the dimples 8 is 4308 $mm^2$. Because the surface area of the phantom sphere 12 of this golf ball 2 is 5728 $mm^2$, the occupation ratio is 75.2%.

The mean diameter Da of the dimple 8 is preferably equal to or greater than 4.0 mm. The golf ball 2 having a mean diameter Da of equal to or greater than 4.0 mm achieves a sufficient lift force. In this respect, the mean diameter Da is more preferably equal to or greater than 4.2 mm. In light of suppression of the drag, and suppression of excessive lift force, the mean diameter Da is preferably equal to or less than 4.9 mm. The mean diameter Da of the golf ball 2 shown in FIGS. 2 and 3 is 4.06 mm.

The proportion P3 of the number of the dimples 8 having a diameter of equal to or greater than 4.3 mm to total number of the dimples 8 is preferably equal to or greater than 30%. According to the golf ball 2 having the proportion P3 of equal to or greater than 30%, a sufficient lift force is achieved. In this respect, the proportion P3 is more preferably equal to or greater than 60%. Ideally, the proportion P3 is 100%. The proportion P3 in the golf ball 2 shown in FIGS. 2 and 3 is 30%.

It is preferred that the standard deviation Σ of the diameter of the dimple 8 be equal to or less than 0.2 mm. According to the golf ball 2 having a standard deviation Σ of equal to or less than 0.2 mm, an adequate lift force is achieved. In this respect, the standard deviation Σ is more preferably equal to or less than 0.1 mm. Ideally, all the dimples 8 have an identical diameter. Therefore, ideal standard deviation Σ is zero assuming that there exists no error in manufacture. Since the mean diameter Da in the golf ball 2 shown in FIGS. 2 and 3 is 4.06 mm as described above, the standard deviation Σ in this golf ball 2 is calculated by the following formula:

$$\Sigma=(((4.40-4.06)^2\cdot 100+(4.00-4.06)^2\cdot 112+(3.85-4.06)^2\cdot 60+(3.80-4.06)^2\cdot 60)/332)^{1/2}$$

The standard deviation Σ of in this golf ball 22 is 0.24.

According to the present invention, the term "dimple volume" means a volume of a part surrounded by a plane that includes the contour of the dimple 8, and the surface of the dimple 8. In light of possible suppression of hopping of the golf ball 2, total volume of the dimples 8 is preferably equal to or greater than 280 $mm^3$, and more preferably equal to or greater than 300 $mm^3$. In light of possible suppression of dropping of the golf ball 2, the total volume is preferably equal to or less than 350 $mm^3$, and more preferably equal to or less than 330 $mm^3$.

From the standpoint that a sufficient occupancy ratio can be achieved, total number of the dimples 8 is preferably equal to or greater than 200, more preferably equal to or greater than 252, and particularly preferably equal to or greater than 272. From the standpoint that respective dimples 8 can have a sufficient diameter, the total number is preferably equal to or less than 362, more preferably equal to or less than 350, and particularly preferably equal to or less than 332.

EXAMPLES

Example 1

A rubber composition was obtained by kneading 100 parts by weight of polybutadiene (trade name "BR-18", available from JSR Corporation), 30 parts by weight of zinc diacrylate, 6 parts of zinc oxide, 10 parts by weight of barium sulfate, 0.5 parts by weight of diphenyl disulfide and 0.5 part by weight of dicumyl peroxide. This rubber composition was placed into a mold having upper and lower mold half each having a hemispherical cavity, and heated at 170° C. for 18 minutes to obtain a core having a diameter of 40.0 mm. On the other hand, 50 parts by weight of an ionomer resin (available from Du Pont-MITSUI POLYCHEMICALS Co., Ltd.; trade name "Himilan 1605"), 50 parts by weight of other ionomer resin (available from Du Pont-MITSUI POLYCHEMICALS Co., Ltd.; trade name "Himilan 1706") and 3 parts by weight of titanium dioxide were kneaded to obtain a resin composition. The aforementioned core was placed into a mold having numerous protrusions on the inside face, followed by injection of the aforementioned resin composition around the spherical body by injection molding to form a cover having a thickness of 1.35 mm. Numerous dimples having a shape inverted from the shape of the protrusion were formed on the cover. A clear paint including a two-part liquid curable polyurethane as a base was applied on this cover to give a golf ball of Example 1 having a diameter of 42.7 mm and a weight of about 45.4 g. The compression of this golf ball measured with a tester from Atti Engineering Co. Ltd., was about 85. This golf ball has a dimple pattern shown in FIG. 2 and FIG. 3. The dimples of this golf ball have a cross-sectional shape shown in FIG. 4 and FIG. 5. Details of specifications of the dimples are presented in Table 1 below.

Examples 2 to 4 and Comparative Examples 1 to 5

Golf balls of Examples 2 to 4 and Comparative Examples 1 to 5 were obtained in a similar manner to Example 1 except that specifications of the dimples were as shown in Table 1 below. The golf ball according to Comparative Example 2 has dimples having a cross section that has a single radius shape.

Travel Distance Test

A driver with a titanium head (trade name "XXIO", available from SRI Sports Limited, shaft flex: S, loft angle: 10°) was attached to a swing machine, available from Golf Lab Co., Ltd. The golf ball kept at 23° C. was hit under the condition to provide a head speed of 45 m/sec. Accordingly, the distance from the launching point to the point where the ball stopped was measured. Mean values of 20 times measurement are presented in Table 2 below.

TABLE 1

Specifications of Dimples

| | Type | Number | Diameter Di (mm) | Diameter D2 (mm) | Width W (mm) | Radius R1 (mm) | Radius R2 (mm) | Depth de (mm) | Depth d1 (mm) | Ratio P1 (%) | Volume ($mm^3$) |
|---|---|---|---|---|---|---|---|---|---|---|---|
| Example 1 | A | 100 | 4.40 | 4.18 | 0.11 | 0.50 | 15.68 | 0.1522 | 0.0123 | 8.1 | 1.135 |
| | B | 112 | 4.00 | 3.80 | 0.10 | 0.50 | 12.97 | 0.1500 | 0.0101 | 6.7 | 0.913 |
| | C | 60 | 3.85 | 3.66 | 0.10 | 0.50 | 12.03 | 0.1492 | 0.0093 | 6.2 | 0.838 |
| | D | 60 | 3.80 | 3.61 | 0.10 | 0.50 | 11.71 | 0.1490 | 0.0091 | 6.1 | 0.814 |
| Example 2 | A | 100 | 4.30 | 4.09 | 0.11 | 0.50 | 14.91 | 0.1522 | 0.0116 | 7.6 | 1.080 |
| | B | 232 | 3.95 | 3.75 | 0.10 | 0.50 | 12.59 | 0.1505 | 0.0099 | 6.6 | 0.892 |
| Example 3 | A | 212 | 4.30 | 4.09 | 0.11 | 0.50 | 16.25 | 0.1405 | 0.0116 | 8.3 | 1.003 |
| | B | 60 | 4.10 | 3.90 | 0.10 | 0.50 | 14.78 | 0.1394 | 0.0105 | 7.5 | 0.899 |
| | C | 60 | 3.90 | 3.71 | 0.10 | 0.50 | 13.38 | 0.1384 | 0.0095 | 6.9 | 0.802 |
| Example 4 | A | 272 | 4.62 | 4.39 | 0.12 | 1.00 | 17.39 | 0.1457 | 0.0066 | 4.5 | 1.158 |
| Compalative Example 1 | A | 392 | 3.85 | 3.66 | 0.10 | 0.50 | 12.60 | 0.1428 | 0.0093 | 6.5 | 0.804 |
| Compalative Example 2 | A | 212 | 4.30 | — | — | — | 16.94 | 0.1370 | — | — | 0.996 |
| | B | 60 | 4.10 | — | — | — | 15.41 | 0.1370 | — | — | 0.906 |
| | C | 60 | 3.90 | — | — | — | 13.95 | 0.1370 | — | — | 0.820 |
| Compalative Example 3 | A | 272 | 4.62 | 4.39 | 0.12 | 0.35 | 20.52 | 0.1347 | 0.0170 | 12.6 | 1.158 |
| Compalative Example 4 | A | 272 | 4.62 | 3.74 | 0.44 | 8.00 | 8.70 | 0.1941 | 0.0121 | 6.2 | 1.157 |

TABLE 1-continued

| Specifications of Dimples | | | | | | | | | | | |
|---|---|---|---|---|---|---|---|---|---|---|---|
| | Type | Number | Diameter Di (mm) | Diameter D2 (mm) | Width W (mm) | Radius R1 (mm) | Radius R2 (mm) | Depth de (mm) | Depth d1 (mm) | Ratio P1 (%) | Volume ($mm^3$) |
| Compalative Example 5 | A | 332 | 4.19 | 3.98 | 0.11 | 0.50 | 15.39 | 0.1403 | 0.0111 | 7.9 | 0.948 |

P1 = (d1/d1) · 100

TABLE 2

Figure 6:
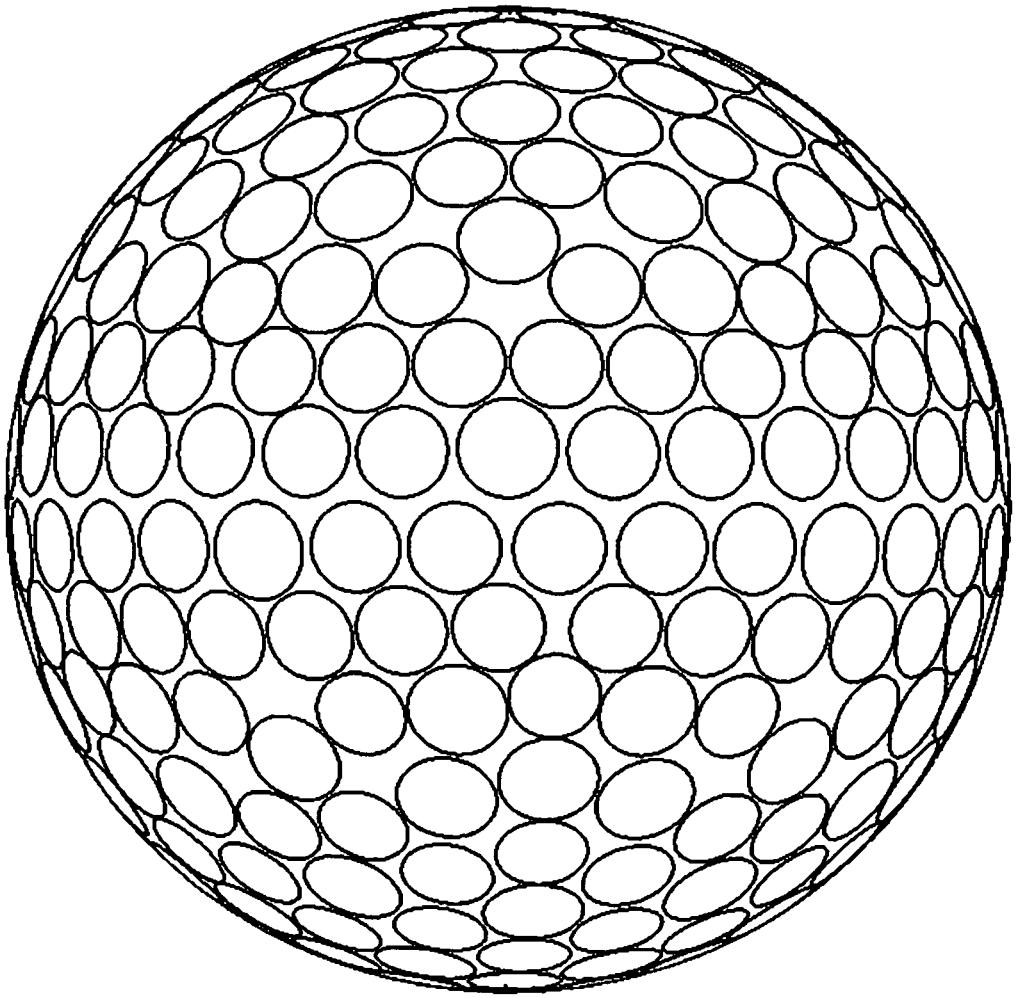
FIG. 6 shows a front view illustrating a golf ball according to Example 2.
Figure 7:
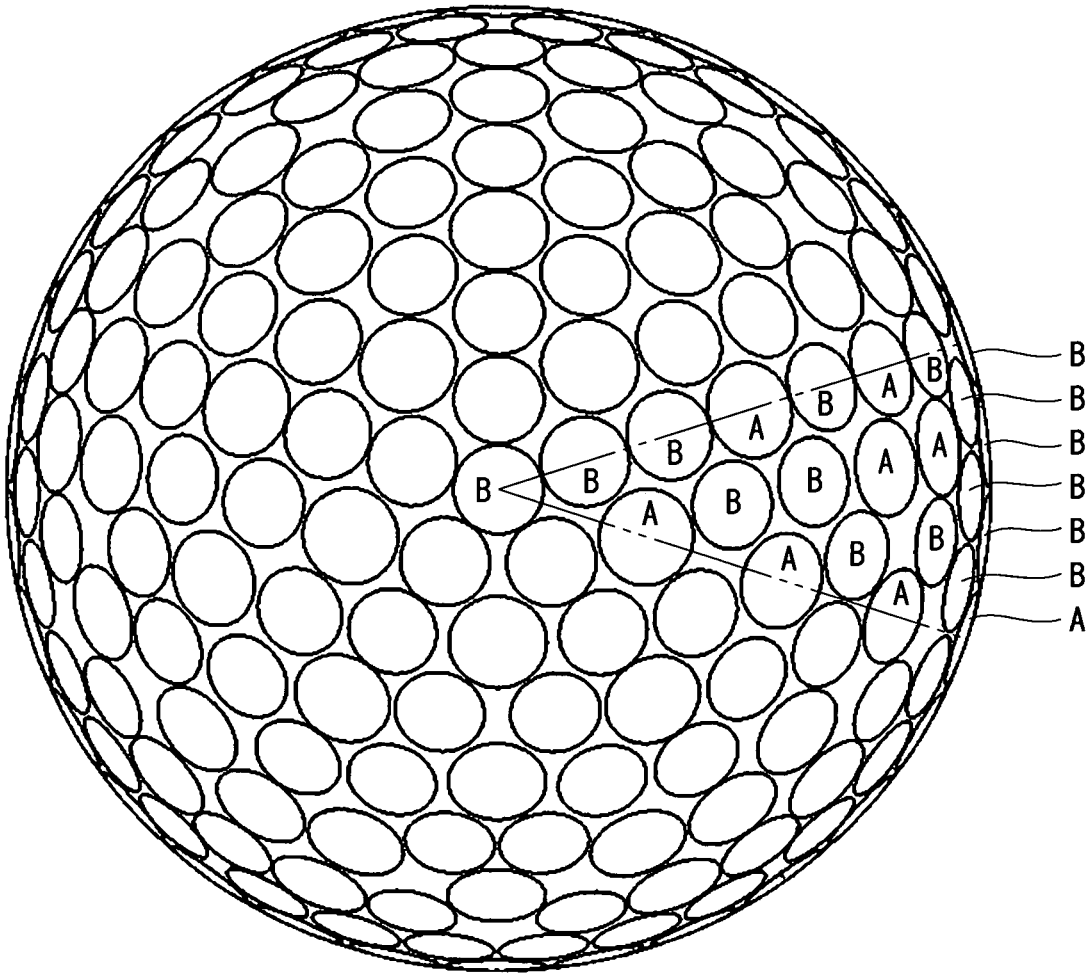
FIG. 7 shows a plan view illustrating the golf ball shown in FIG. 6.
Figure 8:
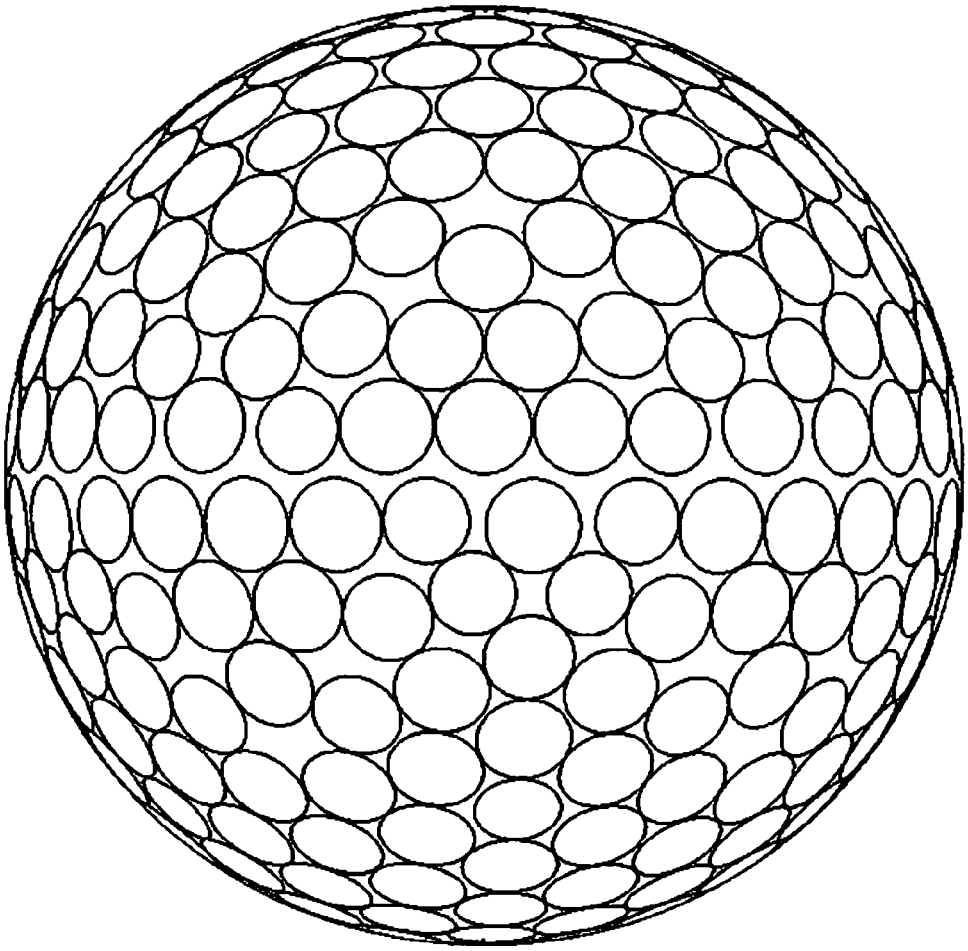
FIG. 8 shows a front view illustrating a golf ball according to Example 3 and Comparative Example 2.
Figure 9:
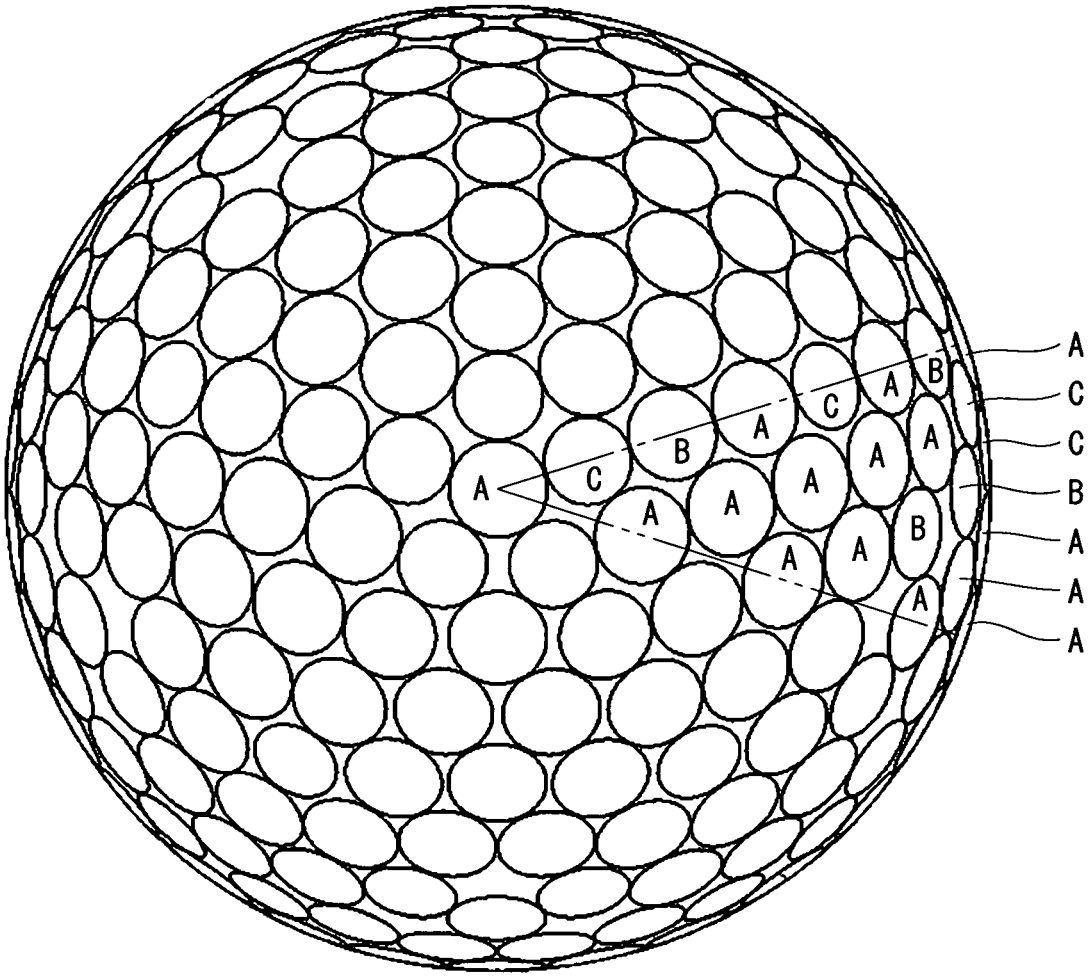
FIG. 9 shows a plan view illustrating the golf ball shown in FIG. 8.
Figure 10:
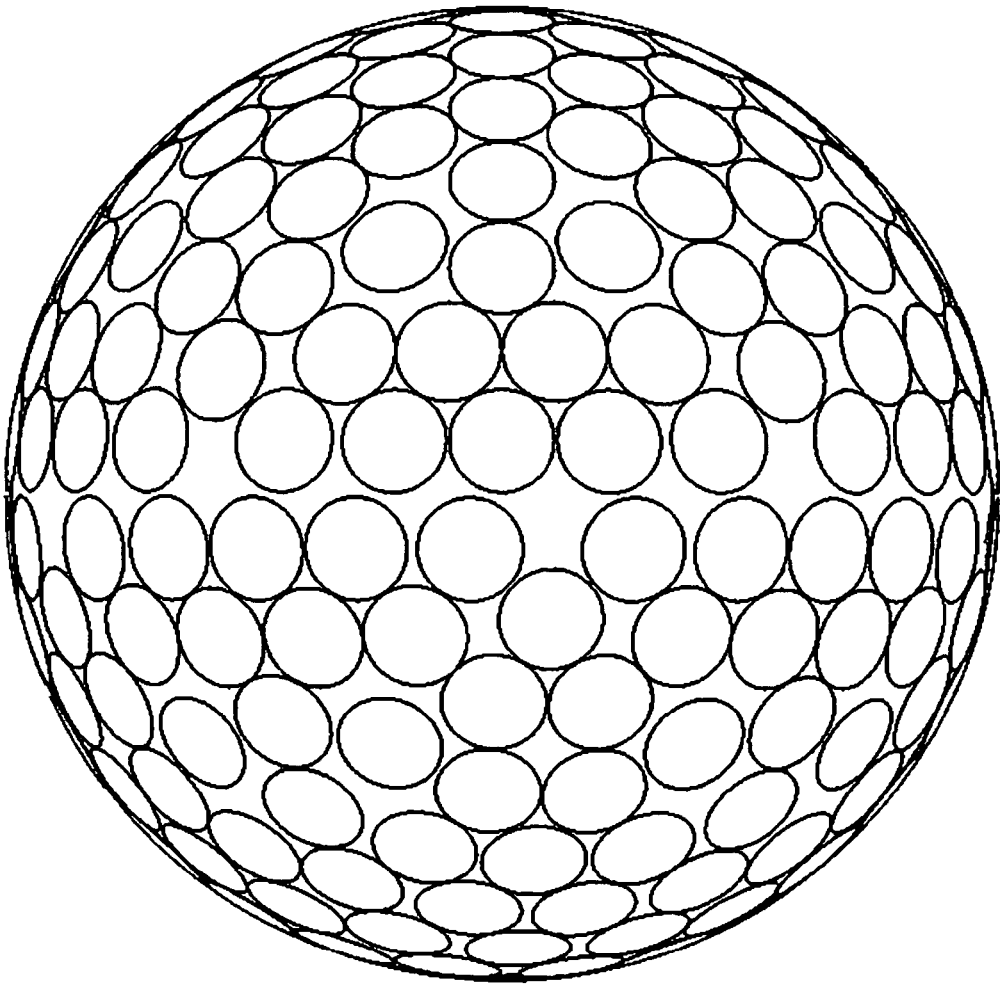
FIG. 10 shows a front view illustrating a golf ball according to Example 4, and Comparative Examples 3 and 4.
Figure 11:
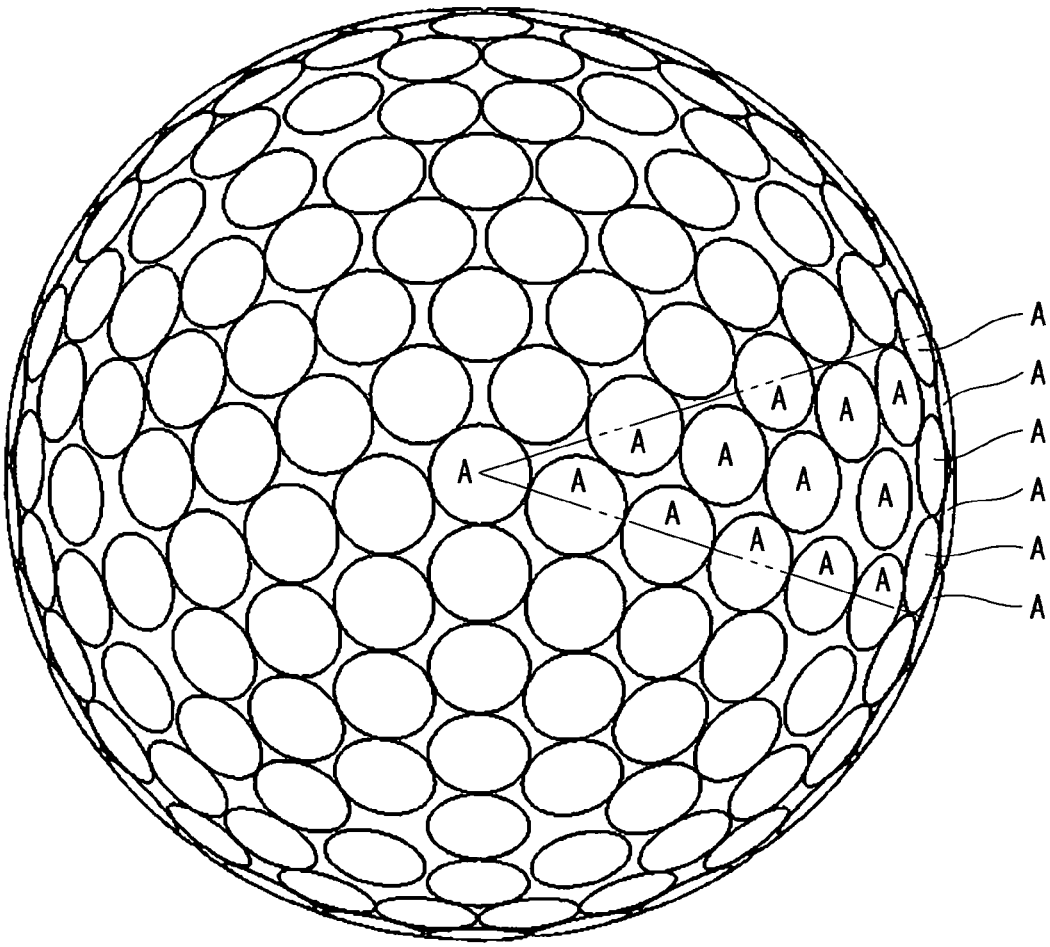
FIG. 11 shows a plan view illustrating the golf ball shown in FIG. 10.
Figure 12:
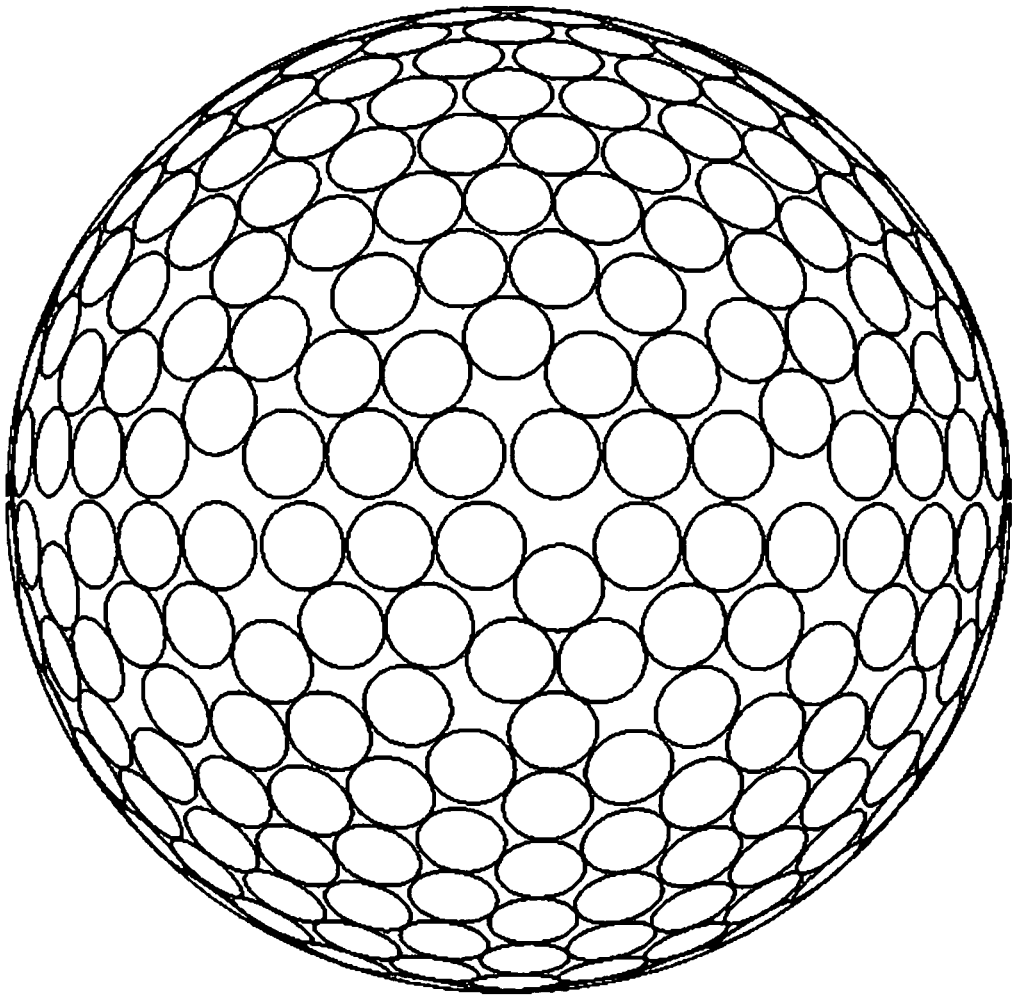
FIG. 12 shows a front view illustrating a golf ball according to Comparative Example 1.
Figure 13:
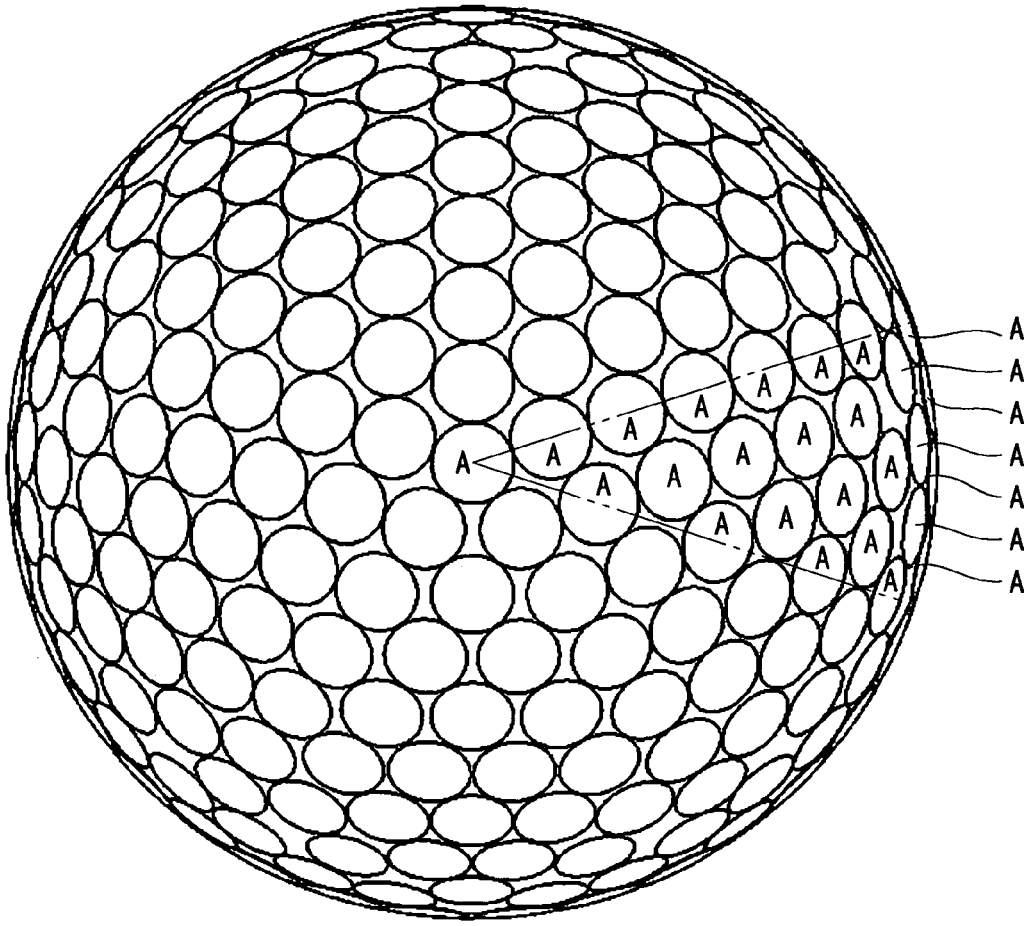
FIG. 13 shows a plan view illustrating the golf ball shown in FIG. 12.
Figure 14:
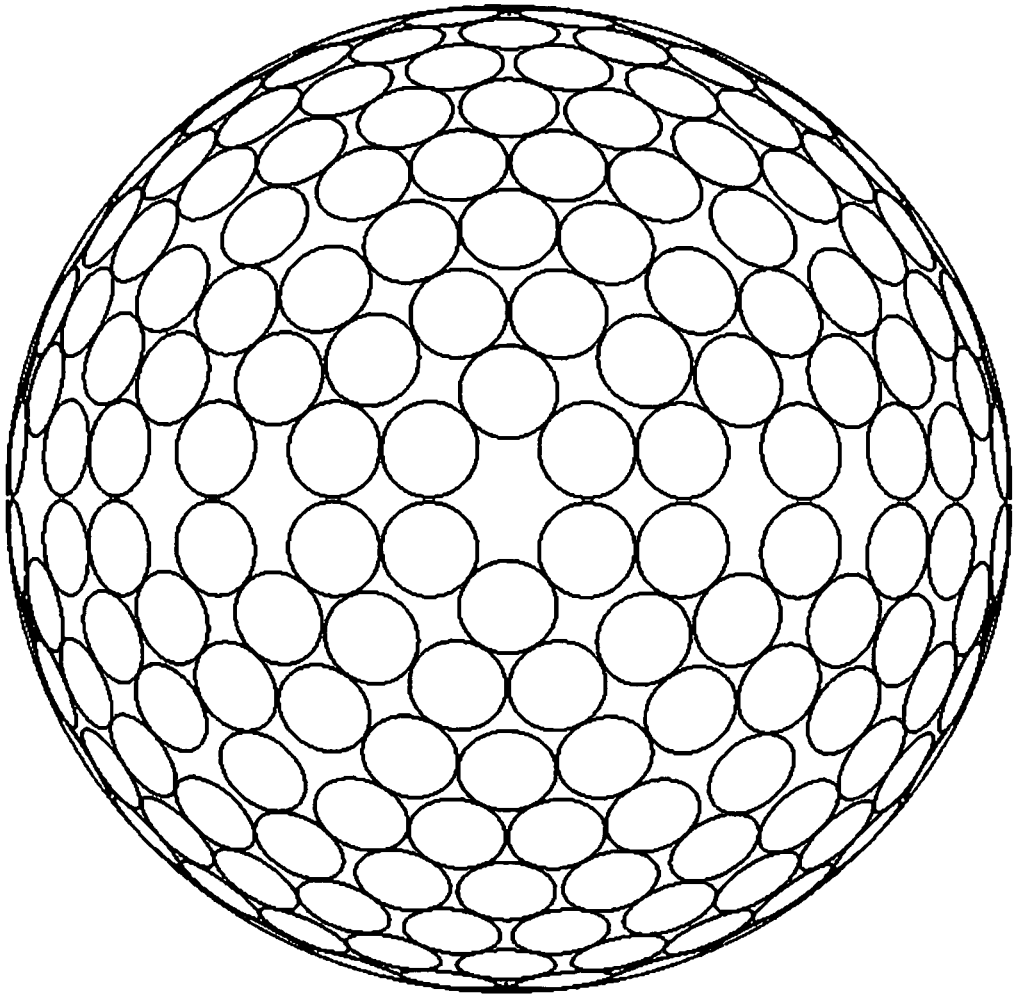
FIG. 14 shows a front view illustrating a golf ball according to Comparative Example 5.

| Results of Evaluation | | | | | | | | | | |
|---|---|---|---|---|---|---|---|---|---|---|
| | | Example 1 | Example 2 | Example 3 | Example 4 | Compa. Example 1 | Compa. Example 2 | Compa. Example 3 | Compa. Example 4 | Compa. Example 5 |
| Pattern | Front view | FIG. 2 | FIG. 6 | FIG. 8 | FIG. 10 | FIG. 12 | FIG. 8 | FIG. 10 | FIG. 10 | FIG. 14 |
| | Plan view | FIG. 3 | FIG. 7 | FIG. 9 | FIG. 11 | FIG. 13 | FIG. 9 | FIG. 11 | FIG. 11 | FIG. 15 |
| Total number | | 332 | 332 | 332 | 272 | 392 | 332 | 272 | 272 | 332 |
| Proportion P2 (%) | | 100 | 100 | 100 | 100 | 100 | 0 | 0 | 0 | 100 |
| Proportion P3 (%) | | 30 | 30 | 64 | 100 | 0 | 64 | 100 | 100 | 0 |
| Mean diameter Da (mm) | | 4.06 | 4.06 | 4.19 | 4.62 | 3.85 | 4.19 | 4.62 | 4.62 | 4.19 |
| Standard deviation Σ | | 0.24 | 0.06 | 0.16 | 0 | 0 | 0.16 | 0 | 0 | 0 |
| Occupation ratio (%) | | 75.2 | 75.0 | 80.1 | 79.6 | 79.7 | 80.1 | 79.6 | 79.6 | 79.9 |
| Total volume ($mm^3$) | | 315 | 315 | 315 | 315 | 315 | 315 | 315 | 315 | 315 |
| Travel Distance (yard) | | 267.5 | 269.8 | 270.4 | 272.1 | 264.9 | 266.2 | 263.9 | 216.1 | 265.3 |

P2: Proportion of dimples having a particular shape

P3: Proportion of the number of dimples having a diameter of equal to or greater than 4.3 mm As shown in Table 2, the golf balls of Examples are excellent in the flight performances. Therefore, advantages of the present invention are clearly suggested by these results of evaluation.

The present invention can be applied to not only two-piece golf balls, but also one-piece golf balls, multi-piece golf balls and wound golf balls. The foregoing description is just for illustrative examples, and various modifications can be made in the scope without departing from the principles of the present invention.

What is claimed is:

1. A golf ball comprising a land and numerous dimples on the surface thereof, wherein the proportion of total area of all the dimples to the surface area of the phantom sphere is equal to or greater than 75%, the mean diameter of the dimples is equal to or greater than 4.0 mm, the proportion of the number of the dimples having a diameter of equal to or greater than 4.3 mm to total number of the dimples is equal to or greater than 30%, and the dimples include dimples having a particular shape as in the following (1) to (4):

(1) having a first curved face that has ring-shape and that is continuous with the land at the edge of the dimple and is projecting upwards;

(2) having a second curved face that has a bowl-shape, and that is continuous with the first curved face, and is projecting downwards and having a curvature radius of equal to or greater than 10 mm; (3) with the depth of the boundary of the first curved face and the second curved face accounting for 1% or greater and 10% or less of the depth of the dimple; and (4) the first curved face meets the second curved surface at a boundary that has a bend or corner, and wherein a width of the first curved face is between 0.05 mm and 0.15 mm.

* * * * *